US005390806A

United States Patent [19]

Elston et al.

[11] Patent Number: 5,390,806

[45] Date of Patent: Feb. 21, 1995

[54] BEAM TANK

[75] Inventors: Malcolm Elston; Peter Lehmann, both of Transvaal, South Africa

[73] Assignee: Henred-Fruehauf Trailers (Proprietary) Ltd., Transvaal, South Africa

[21] Appl. No.: 155,092

[22] Filed: Nov. 19, 1993

[30] Foreign Application Priority Data

Nov. 20, 1992 [ZA] South Africa ..... 92/8980

[51] Int. Cl.[6] ..... B65D 88/00

[52] U.S. Cl. ..... 220/1.5

[58] Field of Search ..... 220/4.12, 1.5

[56] References Cited

U.S. PATENT DOCUMENTS 3,971,491 7/1976 Mowatt-Larssen et al. .... 220/1.5 X
4,065,022 12/1977 Cainaud ..... 220/1.5 X
4,412,626 11/1983 Gerhard ..... 220/1.5
4,469,236 9/1984 Marsault et al. ..... 220/1.5
4,593,832 6/1986 Gerhard ..... 220/1.5
4,603,788 8/1986 Gerhard ..... 220/1.5

*Primary Examiner*—Steven M. Pollard
*Attorney, Agent, or Firm*—Harris, Wallen, MacDermott & Tinsley

[57] ABSTRACT

A beam tank includes a tank mounted on two mountings located one towards either end of the tank and with the tank being secured to the mountings by removable securing means so that the tank can be removed from its mountings. Each mounting includes a tank cradle spaced from and connected to an end frame. The tank is rotatably connected to each of its end frames by tank end connections.

4 Claims, 9 Drawing Sheets

BEAM TANK

INTRODUCTION

This invention relates to a beam tank.

PRIOR ART

Beam tanks are well known. However prior art beam tanks suffer from the disadvantage that the tank is integrally attached to its frame.

OBJECT OF THE INVENTION

It is an object of the invention to provide a beam tank wherein the tank can be removed from its frame.

SUMMARY OF THE INVENTION

A beam tank includes a tank mounted on two mountings located one towards either end of the tank with the tank being secured to the mountings by removable securing means so that the tank can be removed from its mountings.

Each mounting may include a tank cradle and an end frame. The tank cradle may be spaced from and connected to the end frame by connecting means.

The beam tank may include tank end connections which connect the tank to its end frames. Each tank end connection may comprise mating formations with one of the formations being secured to the tank and the other of the formations being connected to the end frame.

The beam tank may be rotatably connected to its end frames by the tank end connections.

The mating formations may be spaced from one another by friction reducing means to facilitate rotation of the mating formations relative to one another so that the tank can rotate relative to its end frames.

The beam tank may include locking means for releasably locking the mating formations together.

The removable securing means may include straps for strapping the tank to its cradles. The removable securing means may also include arms extending from the straps, with the arms being removably fastened to the end frames by fasteners.

According to another aspect of the invention a mounting for a beam tank includes a cradle spaced flora and connected to an end frame by connecting means.

The scope of the invention extends to securing means for removably securing a tank to its mountings to form a beam tank.

Figure 1:
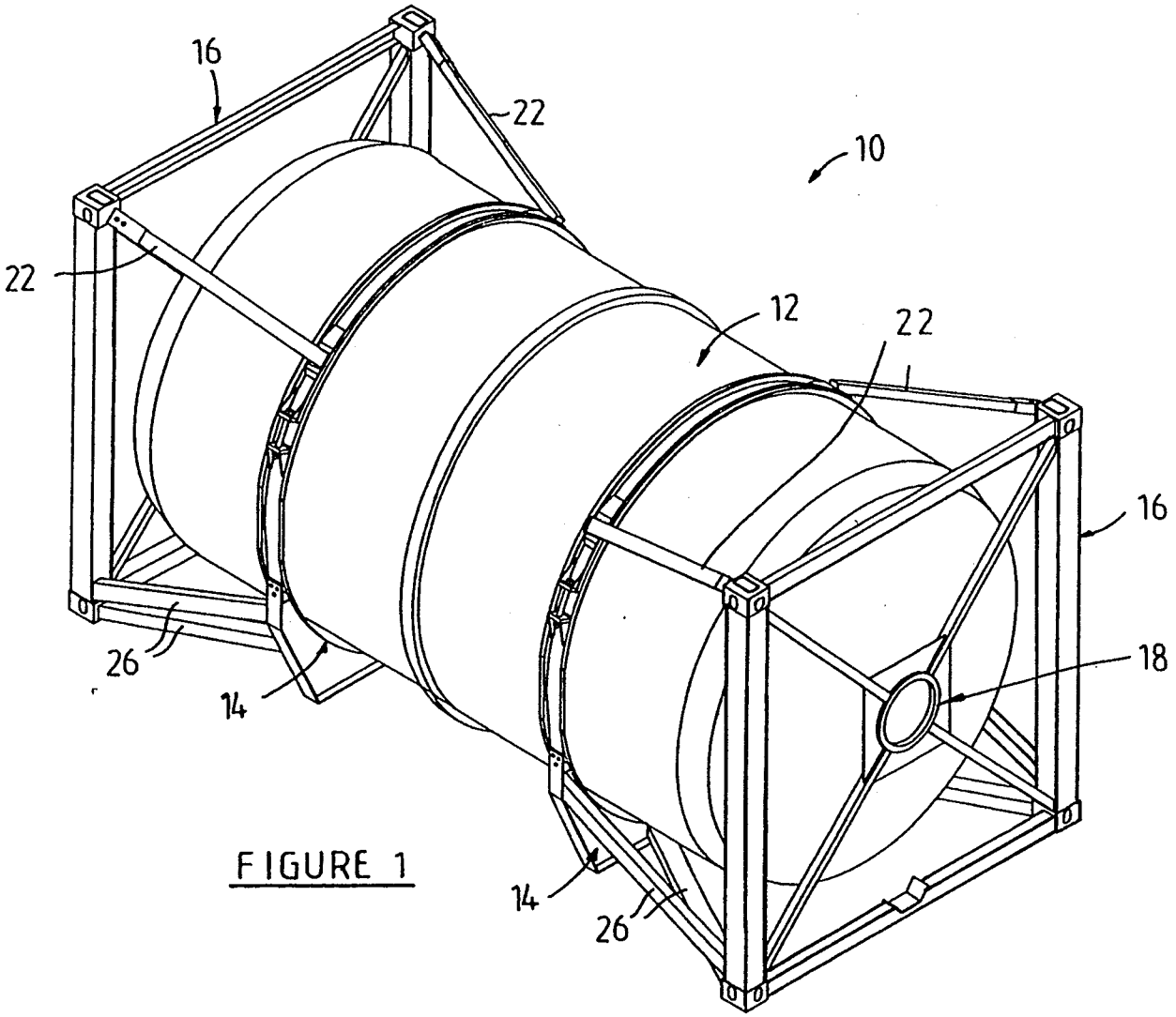
FIG. 1 is a diagrammatic perspective view of a beam tank according to the invention.
Figure 2:
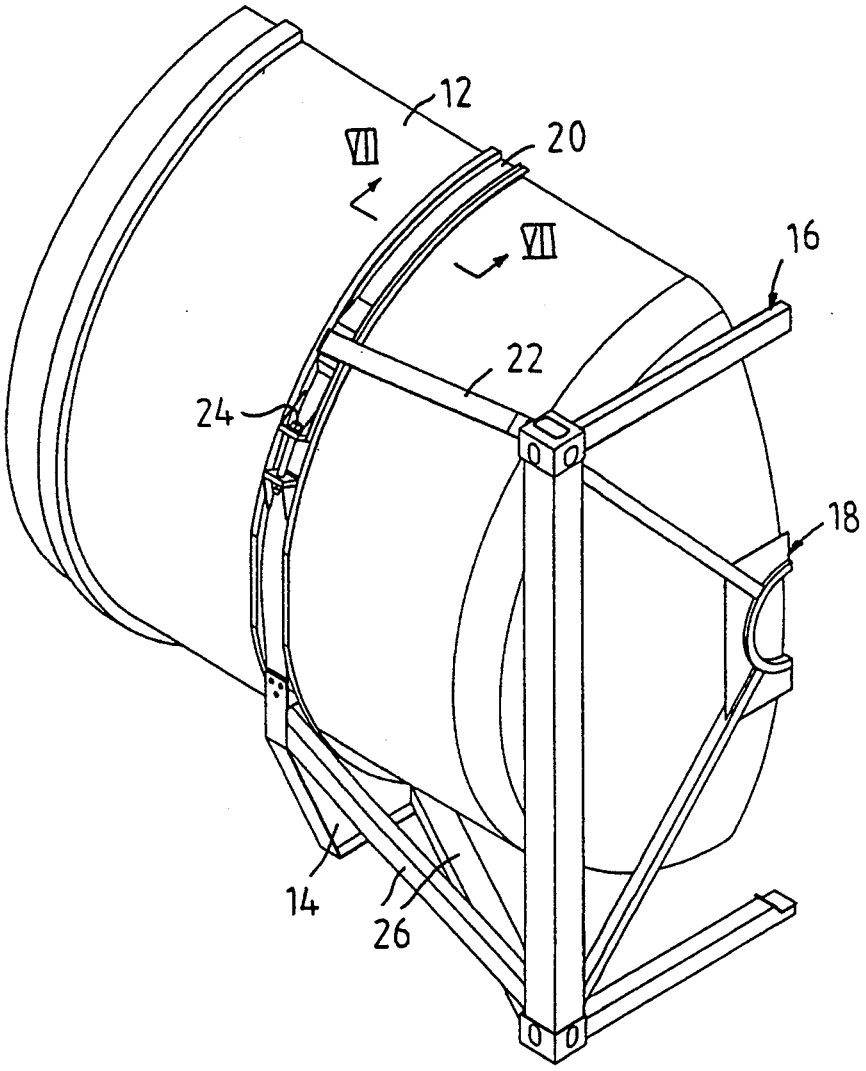
FIG. 2 is a perspective view of part of the beam tank.
Figure 3:
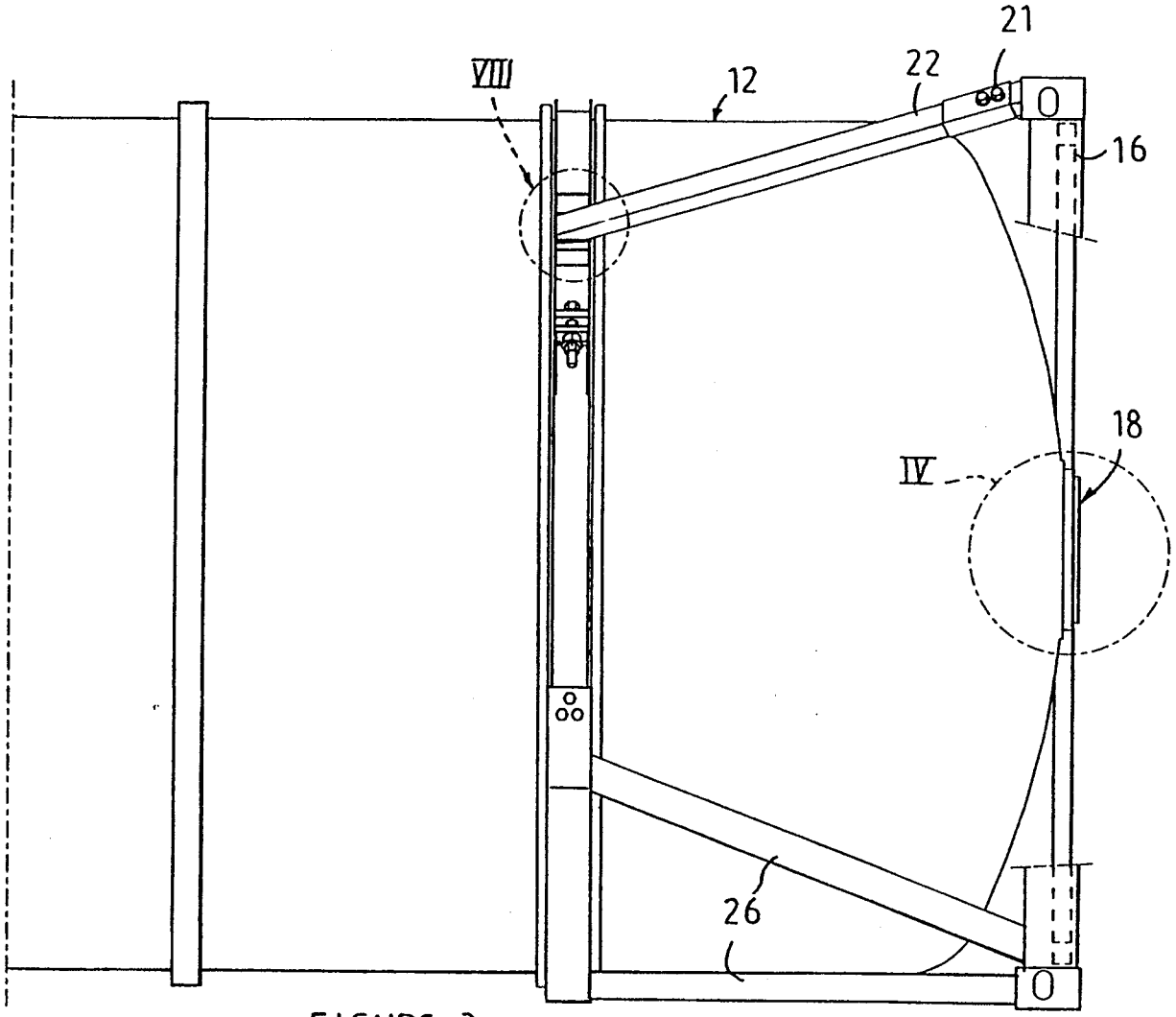
FIG. 3 is a side view of the part of the beam tank of FIG. 2.
Figure 4:
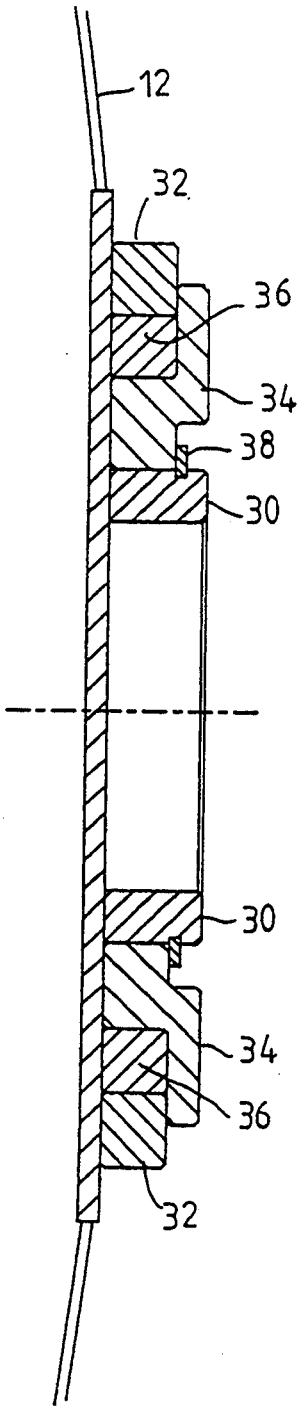
FIG. 4 is an enlarged view of the tank end connection which is shown circled in FIG. 3 and indicated by Roman numeral IV.
Figure 5:
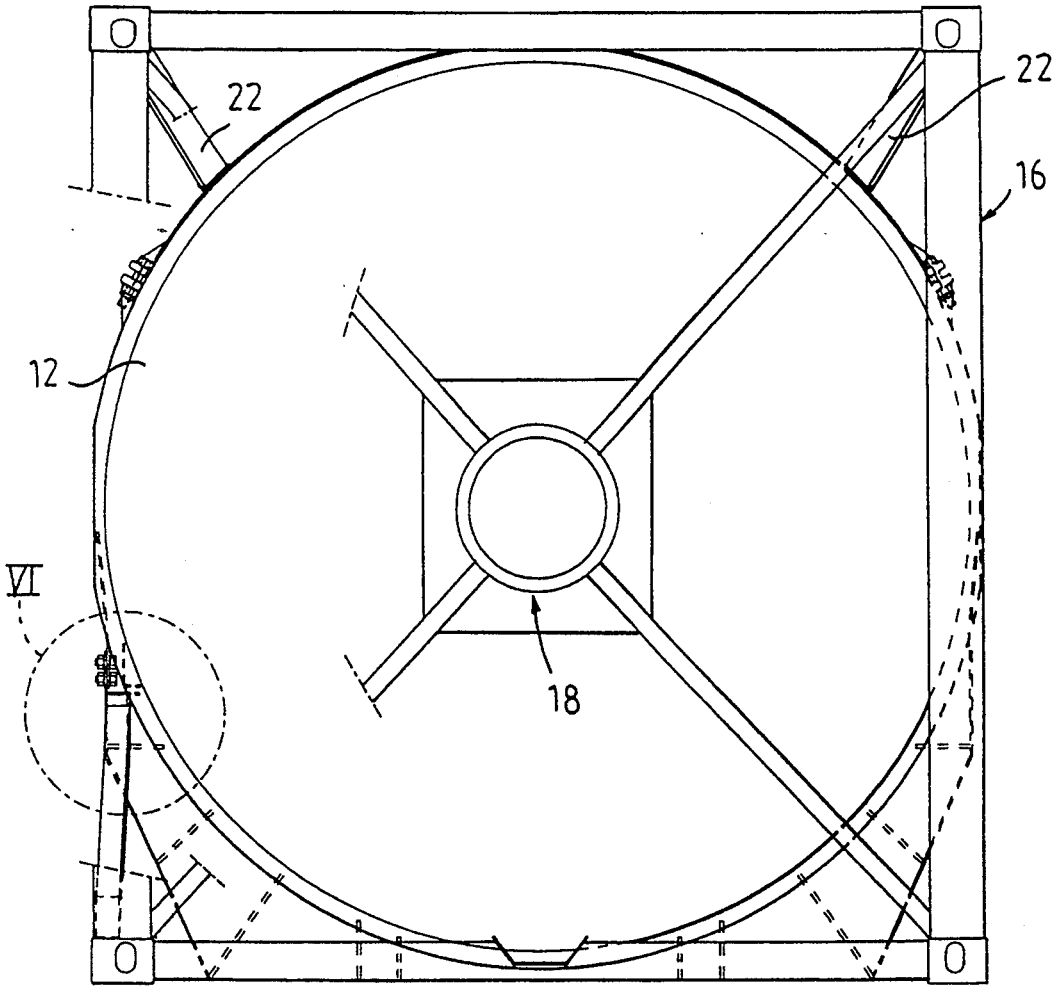
FIG. 5 is a partly cut-away end view of FIG. 3.

Referring to the drawings, a beam tank 10 includes a tank 12 mounted within two cradles 14 which are connected to end frames 16. Tank end connections 18 connect the tank to the end frames 16.

The tank 12 is strapped to the cradles 14 by straps 20 which are connected by arms 22 to the end frames 16. Each arm 22 is bolted to a sleeve 21 extending from the end frame 16. Each arm 22 is also welded to a pedestal 23 which is in turn welded to its respective strap 20. The straps 20 are tensioned by bolts 24.

The cradles 14 are connected to their end frames 16 by struts 26 which are welded to the cradles 14 and to their respective end frames 16.

The straps 20 are spaced from the reinforcing girdles 28 by a shock absorbent material such as rubber 31. The girdles 28 encircle the tank 12 and are welded to the tank 12.

Figure 6:
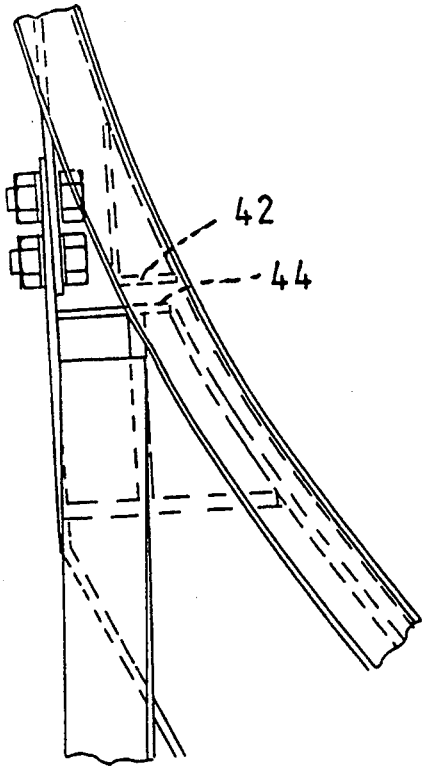
FIG. 6 is an enlarged view of the portion circled in FIG. 5 and indicated by Roman numeral VI.
Figure 7:
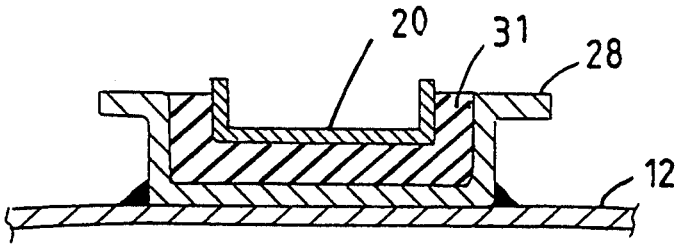
FIG. 7 is a cross-sectional view on line VII—VII of FIG. 2.
Figure 8:
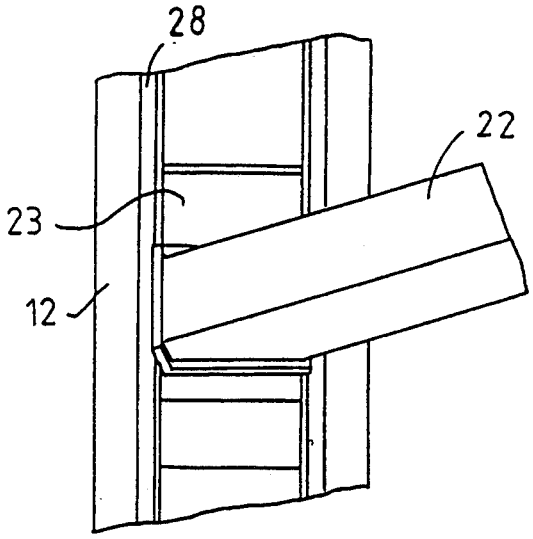
FIG. 8 is an enlarged view of the portion circled in FIG. 3 and indicated by Roman numeral VIII.
Figure 9:
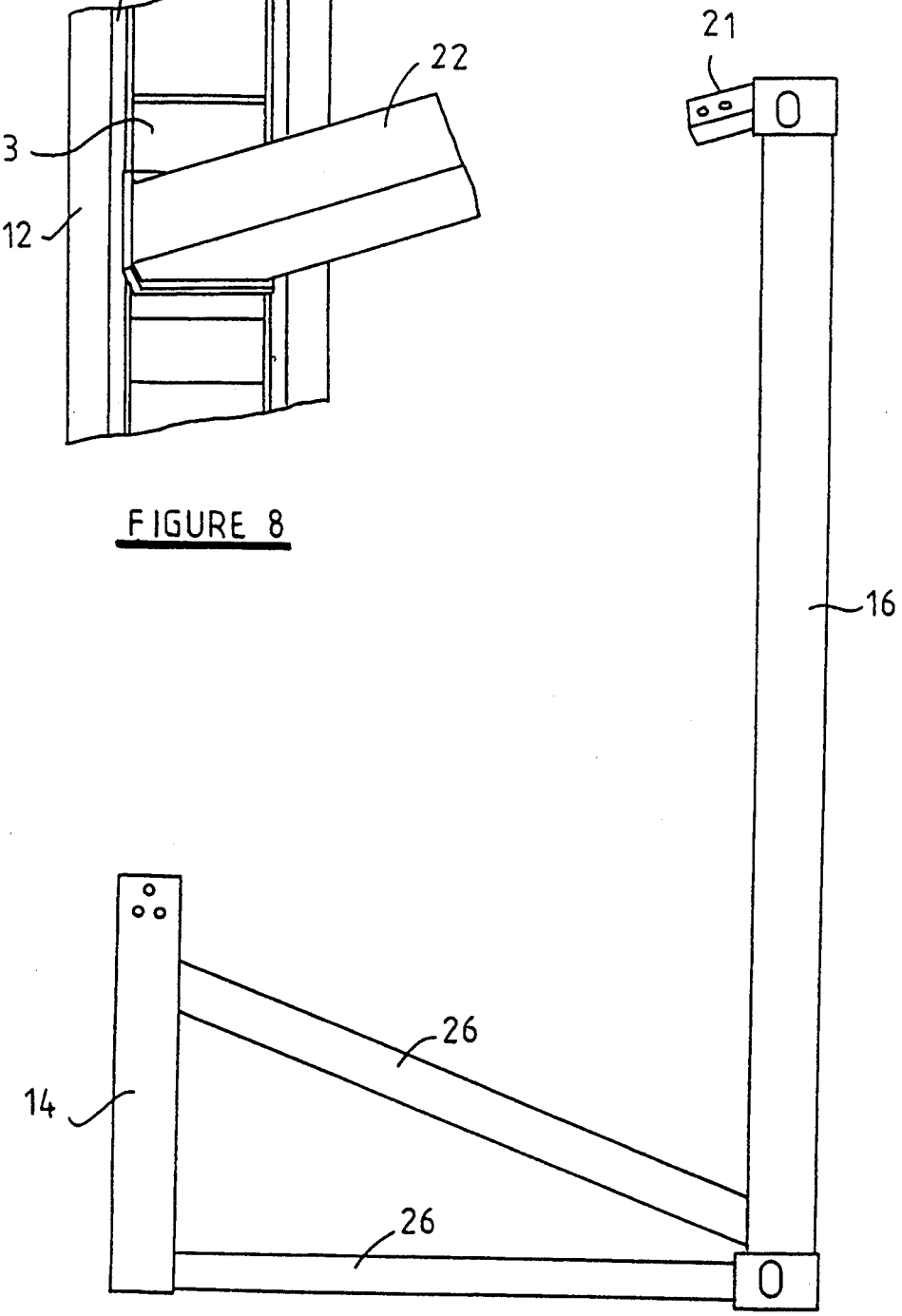
FIG. 9 is a side view of a mounting.
Figure 10:
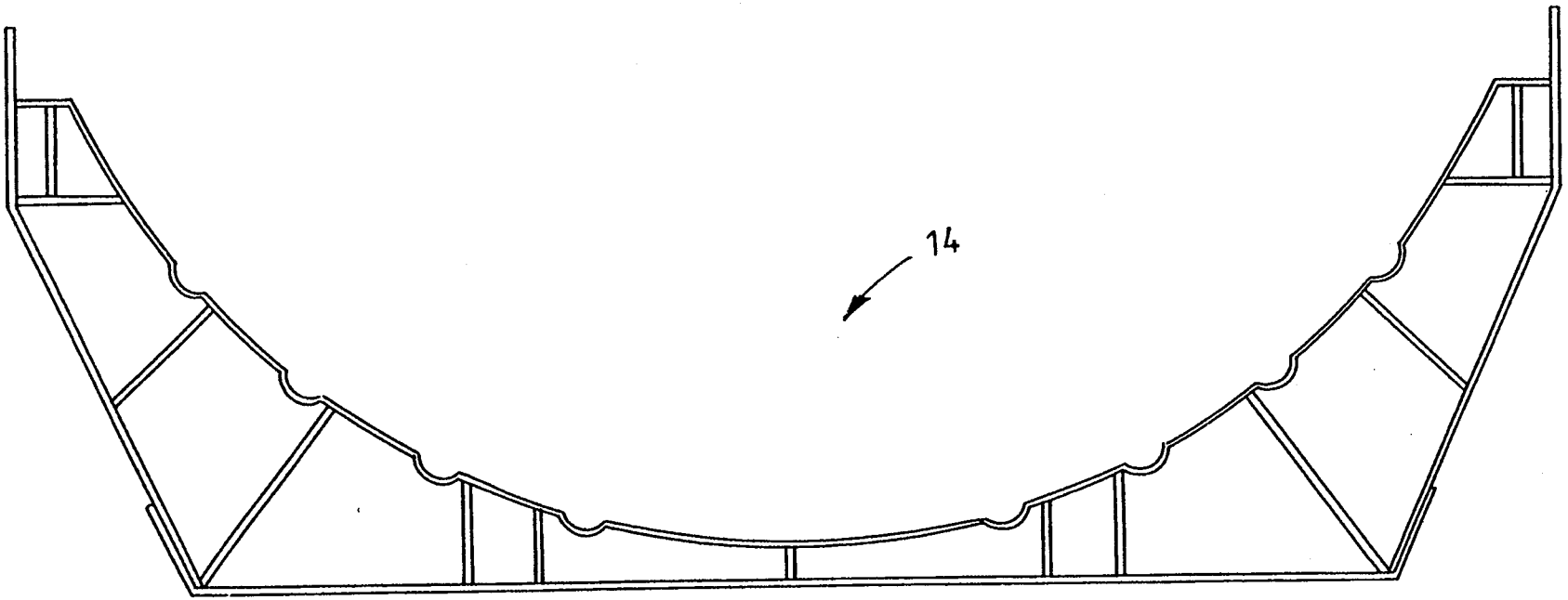
FIG. 10 is an end view of a cradle.

Each tank end connection consists of a male formation 30 welded to the tank 12 and a female formation 32 connected to the end frame 16. A spacer 34 and a friction reducing bush 36 are interposed between the male and female formations. The bush 36 is made of a material sold under the trade name VESCONITE. Locking means in the form of a circlip 38 locks the spacer 34 and hence the female formation 32 to the male formation 30. The male formation 30 and its spacer 34 can rotate relative to the female formation 32. The amount of rotation is determined by the distance between stops 42 and a cradle flange 44 as can be seen in FIG. 6.

The tank 12 can be removed from its cradles 14 and end frames 16 in the following manner: The straps 20 are loosened by removing the bolts 24. The two bolts securing each arm 22 to its sleeve 21 extending from the end frames 16 are removed. The straps 20 and the arms 22, which are welded to the straps 20, can then be removed. The circlip 38 is removed so that the spacer 34 and the bush 36 can be removed. It may be necessary to lift the tank slightly to withdraw the spacer 34. Once the spacer 34 and the bush 36 have been removed, the tank 12 can then be lifted until the male formation 30 abuts the female formation 32. This is sufficient to raise the tank off the cradle 14. The end frame 16 and the cradle 14 can then be slid out from underneath the tank. The same procedure can be used to remove the cradle and end frame from the other side of the tank. The reverse procedure can be utilized to install the cradles and end frames in position around the tank.

It will be appreciated that many modifications or variations of the invention are possible without departing from the spirit or scope of the invention.

We claim:

1. A beam tank including a tank mounted on two mountings located one towards either end of the tank and with the tank being secured to the mountings by removable securing means so that the tank can be removed from its mountings, each mounting comprising a tank cradle spaced from and connected to an end frame by connecting means, and tank end connection means located at opposite ends of the tank for rotatably connecting the tank to the end frame, each tank end connection means comprising formations on the tank and on the end frame releasably locked together by locking means.

2. The beam tank of claim 1 wherein the formations on the tank and on the end frame are spaced from one another by friction reducing means to facilitate rotation of the formations relative to one another so that the tank can rotate relative to its end frame.

3. The beam tank of claim 1 wherein the removable securing means includes straps for strapping the tank to its cradles.

4. The beam tank of claim 3 including arms extending from the straps which arms are removably fastened to the end frames by fasteners.

* * * * *